US006606392B2

(12) United States Patent
Ogawa

(10) Patent No.: US 6,606,392 B2
(45) Date of Patent: Aug. 12, 2003

(54) SPEAKER DEVICE

(75) Inventor: Masuo Ogawa, Osaka (JP)

(73) Assignee: Funai Electric Co., Ltd., Daito (JP)

( * ) Notice: Subject to any disclaimer, the term of this patent is extended or adjusted under 35 U.S.C. 154(b) by 0 days.

(21) Appl. No.: 10/146,381

(22) Filed: May 15, 2002

(65) Prior Publication Data

US 2002/0172391 A1 Nov. 21, 2002

(30) Foreign Application Priority Data

May 15, 2001 (JP) ..... 2001-002982 U

(51) Int. Cl.[7] ..... H04R 25/00

(52) U.S. Cl. ..... 381/386; 381/392; 381/398; 181/171

(58) Field of Search ..... 381/386, 389, 381/395, 398, 87, 392; 181/150, 171, 172, 199

(56) References Cited

U.S. PATENT DOCUMENTS 4,072,829 A * 2/1978 Ogihara ..... 381/392
4,815,558 A * 3/1989 Krainhofer ..... 181/150
4,852,178 A * 7/1989 Inkman et al. ..... 381/386

FOREIGN PATENT DOCUMENTS

| | | |
|---|---|---|
| JP | 61-97290 | 6/1986 |
| JP | 63-133791 | 9/1988 |
| JP | 3063297 | 8/1999 |

* cited by examiner

*Primary Examiner*—Huyen Le
(74) *Attorney, Agent, or Firm*—Rosenthal & Osha L.L.P.

(57) ABSTRACT

A holder 1 is provided with two first engaging frame parts 2 and 3 and one second engaging frame part 4. The second engaging frame part 4 includes a pair of supporting parts 41, an elastic beam part 42, and an operating piece 44. The elastic beam part 42 is bendable outward and twistable. A width of the opening of the second engaging frame part 4 is shorter than the sum of a thickness of a flange 61 and a thickness of an edge frame member 62. When the elastic beam part 42 is twisted, the opening width of the second engaging frame part 4 is increased, and the elastic beam part 42 comes in engagement with the rear surface of the flange 61.

5 Claims, 5 Drawing Sheets

SPEAKER DEVICE

BACKGROUND OF THE INVENTION

The present invention relates to a speaker device, and more particularly to a speaker device attached to a cabinet of a TV set or the like.

Some conventional practices to attach a speaker to a cabinet of a TV set or the like are to fasten the speaker to the cabinet by means of screws, and to mount a speaker device, which is formed by mounting the speaker onto the holder by means of screws, on a cabinet by means of screws.

There are proposed various approaches in which the speaker is mounted onto a grill or a cabinet by other fixing means than the screws.

An example of those approaches is the Unexamined Japanese Utility Model Application Publication No. Sho63-133791. In the approach, a speaker grill is installed with two hooks and one holding member. A flange formed on the outer periphery of the speaker is engaged at two locations with the hooks. The flange is also engaged at another location to the holding member. A fixing member is engaged to the two hooks. In this way, those hooks are clamped. (First related art)

Another approach is the Unexamined Japanese Utility Model Application Publication No. Sho61-97290. In the approach, to mount the speaker on a circuit board, an annular member shaped like a segmental arch is fit to the speaker flange, and engaging pawls of the annular member are engaged with engaging holes of the circuit board. (Second related art)

Yet another approach is the registered Japanese Utility Model No. 3063297. The approach discloses a speaker device. The speaker device includes a speaker and a holder. Engaging frames are provided at three locations around the holder. A flange of the speaker is held at three locations by the engaging frames. (Third related art)

To mount the speaker on the cabinet or the holder by means of screws, the screws are excessively needed, and further much labor is taken to fasten the screws.

In this connection, the first to third related arts are capable of mounting the speakers on the grill, circuit board, holder and the like without the use of screws. Accordingly, those related arts are free from the problems of the excessive screws, and taking much labor for the screw fastening.

However, the first and second related arts do not have means for absorbing a variation of the sum of a thickness of the speaker flange and a thickness of the annular edge frame formed of a wedge board, provided on the front surface of the flange. Presence of such a thickness dimension variation makes the mounting state instable. A called chattering sound caused by a sound produced from the speaker is liable to be generated. No description of the means for absorbing the dimension variation is found also in the third related art.

SUMMARY OF THE INVENTION

In the circumstances mentioned above, the present invention is made, and has an object to provide a speaker device which secures a stable speaker mounting state by absorbing a variation of the sum of a thickness of the speaker flange and a thickness of the annular edge frame, while enabling one to mount the speaker on the holder without screws.

Another object of the present invention is to provide a speaker device which stabilizes a mounting state of a speaker, and hence suppresses generation of a called chattering sound caused by an instable mounting of a speaker, thereby improving a quality of sound generated.

Yet another object of the invention is to provide a speaker device which is excellent in the execution of speaker mounting work when the speaker is mounted on the holder.

A speaker device of the invention has a speaker provided with a flange extending along the outer periphery, the flange including an edge frame member on the front surface thereof, and a holder including an annular seat surface over which the edge frame member is entirely laid, and engaging frame parts provided at a plurality of locations on the seat surface, the engaging frame parts being engaged with the rear surface of the flange to position the flange and press the flange against the seat surface.

In the speaker device, the plurality of engaging frame parts, when predetermined locations of the flange are inserted thereinto, are classified into first engaging frame parts which clamp the predetermined locations in cooperation with the seat surface, and a second engaging frame part which clamps the remaining predetermined location in cooperation with the seat surface. The second engaging frame part includes an elastic beam part, when the remaining location of the flange which engages at the predetermined locations with the first engaging frame parts is pushed down to the vicinity of the seat surface, the elastic beam part is bent outward by the outer edge of the flange at the remaining part, and when the edge frame member comes in contact with the seat surface, the elastic beam part is brought into elastic contact with the outer edge of the flange. When the elastic beam part being in resilient contact with the outer edge of the flange is twisted, the elastic beam part comes in engagement with the rear surface of the flange at the remaining location.

In the invention, the first engaging frame parts and the second engaging frame part cooperate to clamp the flange of the speaker and the edge frame member. Accordingly, there is no need of using screws for mounting the speaker on the holder. When the remaining location of the flange which engages at the predetermined locations with the first engaging frame parts is pushed down to the vicinity of the seat surface, the elastic beam part of the second engaging frame part is bent outward by the outer edge of the flange at the remaining part, and when the edge frame member comes in contact with the seat surface, the elastic beam part is brought into elastic contact with the outer edge of the flange. Thus, by merely twisting the elastic beam part elastically contacting with the outer edge of the flange, the elastic beam part comes in engagement with the rear surface of the flange at the remaining part. Accordingly, the speaker may be mounted on the holder by performing the work of pushing downward the remaining part of the flange of the speaker and the work of twisting the elastic beam part. Further, the twist deformed elastic beam part of the holder always brings the flange of the speaker into resilient contact with the seat surface by its action of elastically returning. Accordingly, the speaker is attached to the holder firmly or with no play. Additionally, a variation of the sum thickness of the flange and the edge frame member is also absorbed through the elastic deformation of the elastic beam part which was twist deformed and engaged with the rear surface of the flange.

In the invention, the second engaging frame part is formed integrally with the holder made of synthetic resin by one-piece molding, and the second engaging frame part is formed with a couple of supporting parts raised from the seat surface, an elastic beam part transversely extended between the supporting parts, and an opening defined by the seat surface, the supporting parts and the elastic beam part. A distance between the seat surface and the elastic beam part is somewhat shorter than the sum of a thickness of the flange at the remaining location and a thickness of the edge frame member, and when the elastic beam part is twisted, the distance between the seat surface and the elastic beam part is increased, and the elastic beam part comes in engagement with the rear surface of the flange at the remaining location. With the characteristic features, variations of the thickness dimensions of the flange and the edge frame member are reliably absorbed through the elastic deformation of the elastic beam part. The mounting of the speaker on the holder is further stabilized.

In the invention, it is preferable that an operating piece for twisting the elastic beam part protrudes upward from a mid part of the elastic beam part. The feature provides such an advantage that the twisting deformation of the elastic beam part may simply be carried out by pushing down the operating piece.

In the invention, it is preferable that the elastic beam part and the operating piece are curved inward to take a curved configuration as viewed from top. With this feature, a large engaging width of the elastic beam part when it is engaged with the rear surface of the flange is secured, and it is easy to stabilize the mounting state of the speaker. The elastic beam part and the operating piece are both curved inward to take a curved configuration as viewed from top. Accordingly, if the elastic beam part is made thin, it exhibits a sufficiently large elasticity, to facilitate the stability of the mounting of the speaker.

In a preferred embodiment of the invention, there is provided a speaker device having a speaker provided with a flange extending along the outer periphery, the flange including an annular edge frame member formed of a wedge board on the front surface thereof, and a holder including an annular seat surface over which the edge frame member is entirely laid, and engaging frame parts provided at three locations on the seat surface, the engaging frame parts being engaged with the rear surface of the flange to position the flange and press the flange against the seat surface.

The speaker device has the following characteristic features: the engaging frame parts include each a pair of supporting parts raised from the seat surface, a beam part being transversely extended between the supporting parts and curved inward when viewed from top, and an opening defined by the seat surface, the supporting parts and the beam part; the engaging frame parts, when predetermined locations of the flange are inserted thereinto, are classified into two first engaging frame parts which clamp two of the predetermined locations in cooperation with the seat surface, and one second engaging frame part which clamps the remaining predetermined location in cooperation with the seat surface; the second engaging frame part is formed integrally with the holder made of synthetic resin by one-piece molding, and a beam part of the second engaging frame part is formed as an beam part being bendable outward and twistable; a distance between the seat surface and the elastic beam part in the second engaging frame part is somewhat shorter than the sum of a thickness of the flange at the remaining location and a thickness of the edge frame member; when the elastic beam part is twisted, the distance between the seat surface and the elastic beam part is increased, and the elastic beam part comes in engagement with the rear surface of the flange at the remaining location; an operating piece for twisting the elastic beam part protrudes upward from a mid part of the elastic beam part, and the operating piece is curved inward to take a curved configuration as viewed from top; and when the remaining location of the flange which engages at the predetermined locations with the two first engaging frame parts is pushed down to the vicinity of the seat surface, the elastic beam part of the second engaging frame part is bent outward by the outer edge of the flange at the remaining part, and when the edge frame member comes in contact with the seat surface, the elastic beam part is brought into elastic contact with the outer edge of the flange.

The speaker device thus uniquely constructed is capable of completely satisfying the operations and effects of the speaker device as described above.

DETAILED DESCRIPTION OF THE PREFERRED EMBODIMENTS

Figure 1:
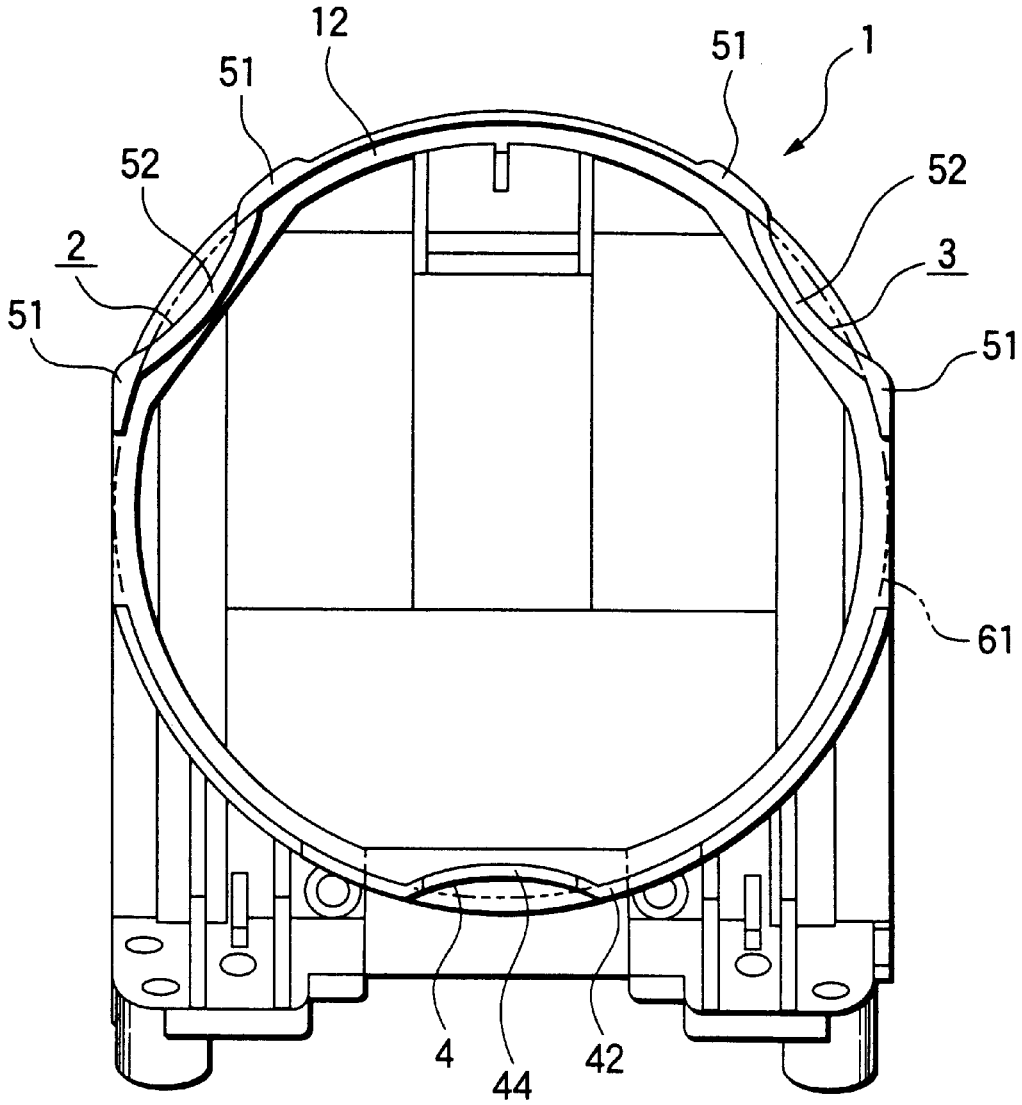
FIG. 1 is a plan view showing a holder used for a speaker device which is an embodiment of the present invention.
Figure 2:
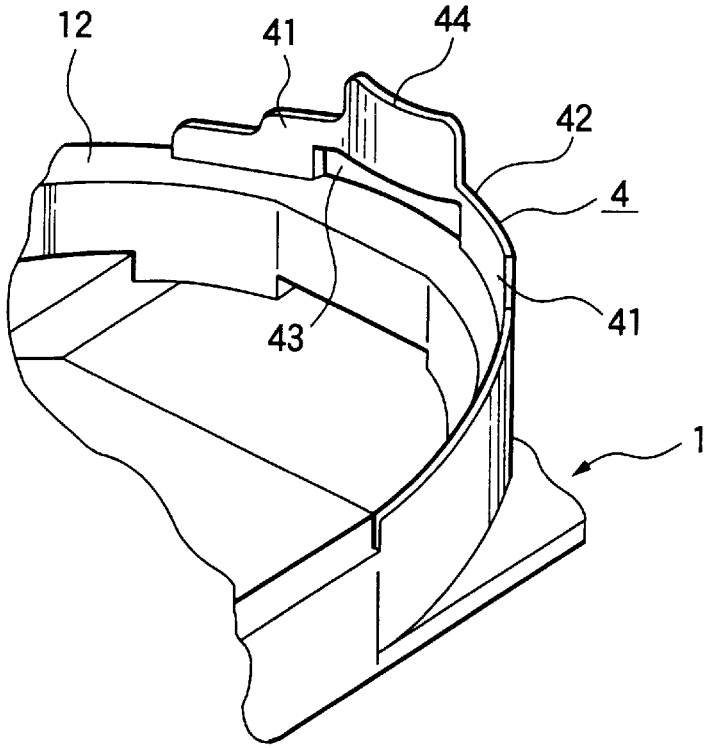
FIG. 2 is a perspective view showing a key portion of the holder.
Figure 3:
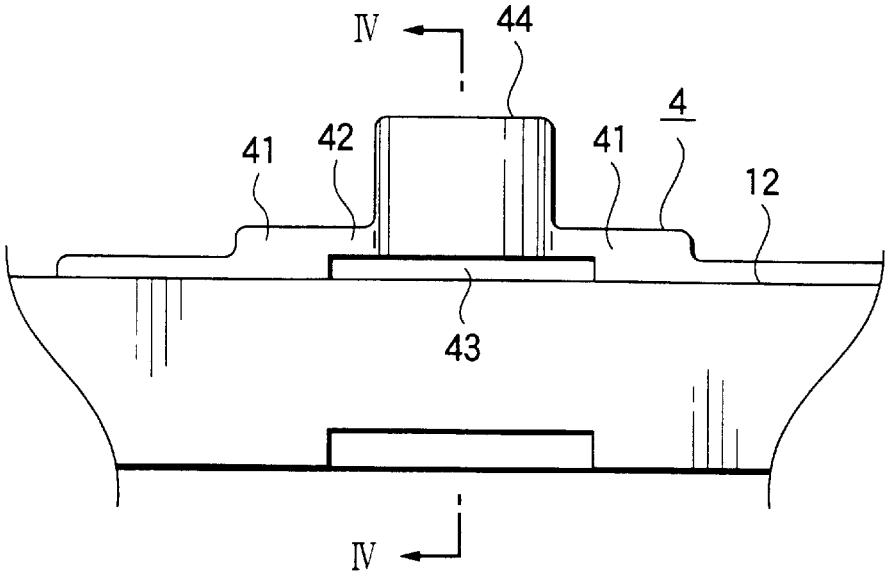
FIG. 3 is a front view showing a key portion of the holder.
Figure 4:
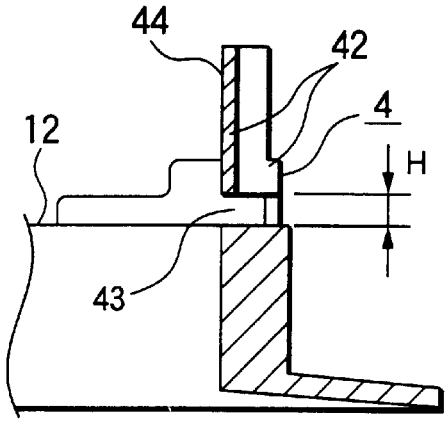
FIG. 4 is an enlarged, sectional view taken on line IV—IV in FIG. 3.
Figure 5:
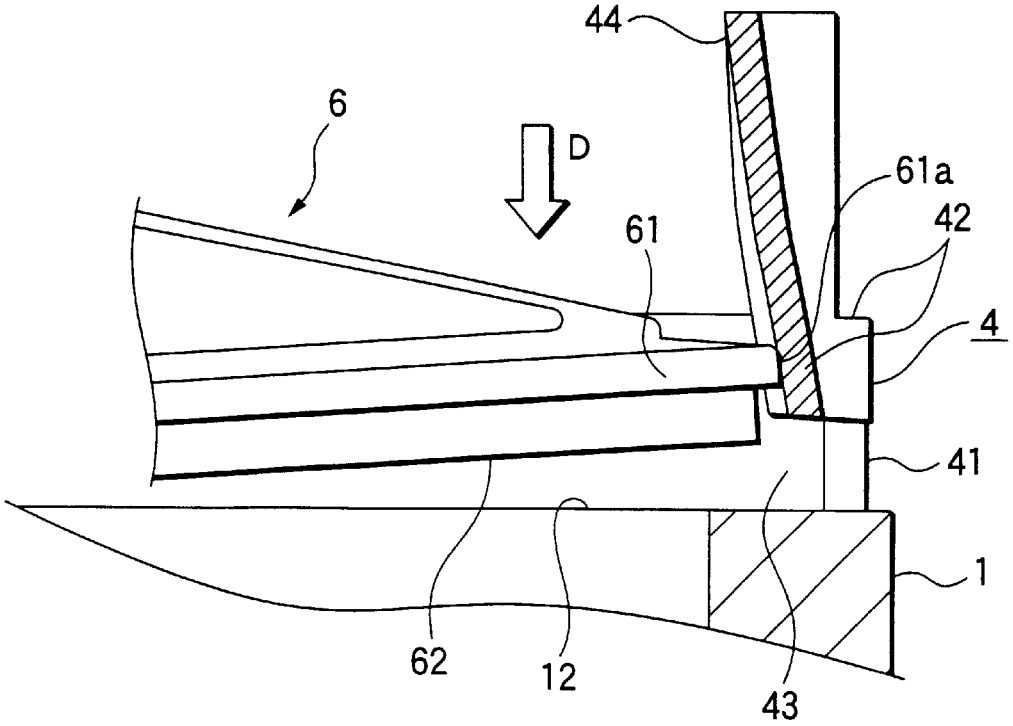
FIG. 5 is an explanatory diagram useful in explaining an initial stage of a procedure of mounting the speaker device on the holder.
Figure 6:
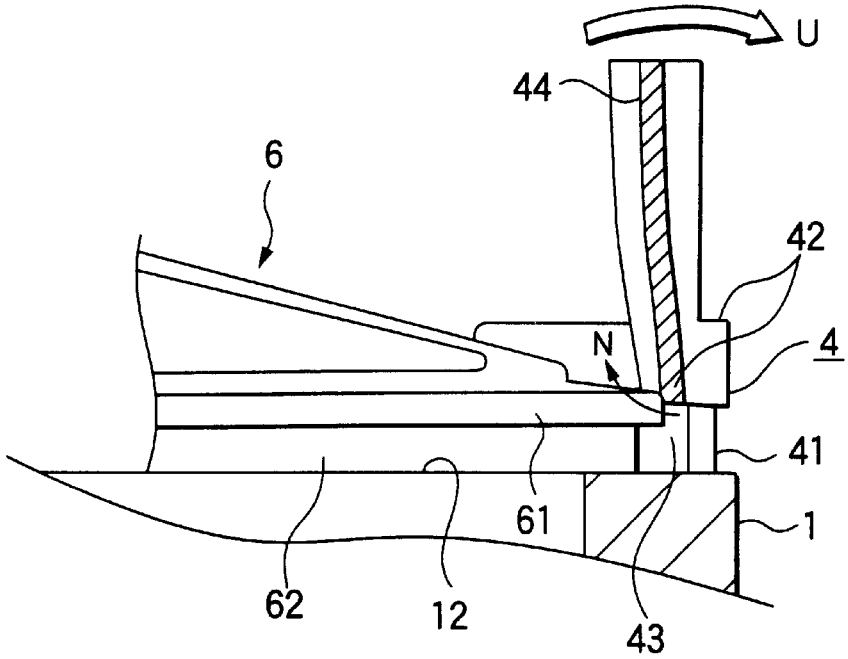
FIG. 6 is an explanatory diagram useful in explaining a medium stage of the procedure of mounting the speaker device on the holder.
Figure 7:
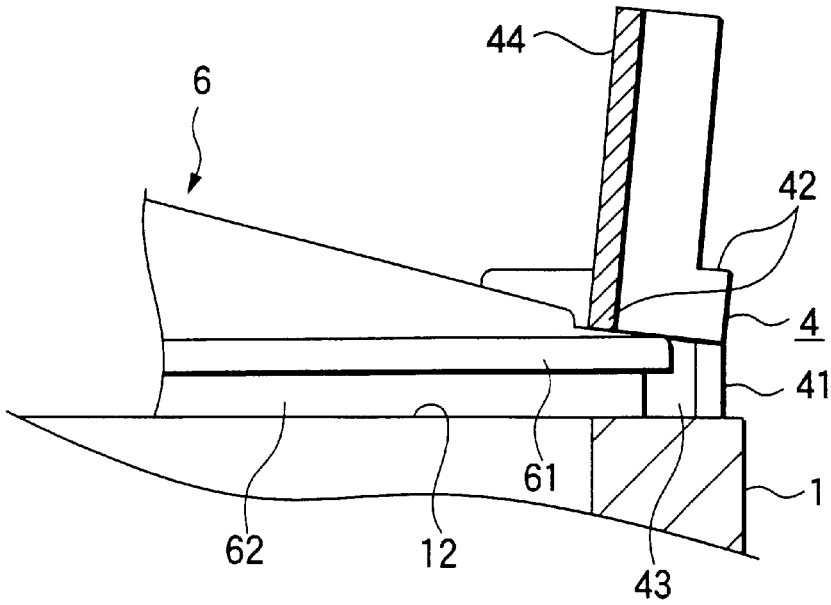
FIG. 7 is an explanatory diagram useful in explaining a final stage of the procedure of mounting the speaker device on the holder.

FIG. 1 is a plan view showing a holder used for a speaker device which is an embodiment of the present invention; FIG. 2 is a perspective view showing a key portion of the holder; FIG. 3 is a front view showing a key portion of the holder; FIG. 4 is an enlarged, sectional view taken on line IV—IV in FIG. 3; FIGS. 5 to 7 are explanatory diagrams useful in explaining procedures of mounting the speaker device on the holder; and FIG. 8 is a side view showing the speaker device.

As shown in FIG. 1, a holder 1 is formed of synthetic resin by one-piece molding, and includes an annular seat surface 12, and three engaging frame parts 2, 3, 4, which are raised from the seat surface 12 at three locations. Those engaging frame parts 2, 3, 4 are classified into two first engaging frame parts 2 and 3, and one of the second engaging frame part 4. The two first engaging frame parts 2 and 3 are disposed equiangularly spaced from the one second engaging frame part 4. As shown in FIGS. 2 to 4, the second engaging frame part 4 is formed with a couple of wide supporting parts 41 raised from the seat surface 12, an elastic beam part 42 transversely extended between those supporting parts 41, and a rectangular, sideways elongated opening 43 defined by the seat surface 12, supporting parts 41 and the elastic beam part 42. Further, a rectangular operating piece 44 protrudes upward from a mid part of the elastic beam part 42. The elastic beam part 42 and the operating piece 44 are curved inward when viewed from top. The supporting parts 41, elastic beam part 42 and operating piece 44 of the second engaging frame part 4 are relatively thin. Accordingly, the elastic beam part 42 is twistable and flexible outward since it has an elasticity proper to the synthetic resin. For the same reason, the operating piece 44 is bendable outward. The supporting parts 41 may be deformed to fall outward.

A distance H between the seat surface 12 and the elastic beam part 42 in the second engaging frame part 4 is somewhat shorter than the sum T (see FIG. 8) of a thickness of a flange 61 of a speaker 6 at another location to be described later and a thickness of an edge frame member 62.

Figure 8:
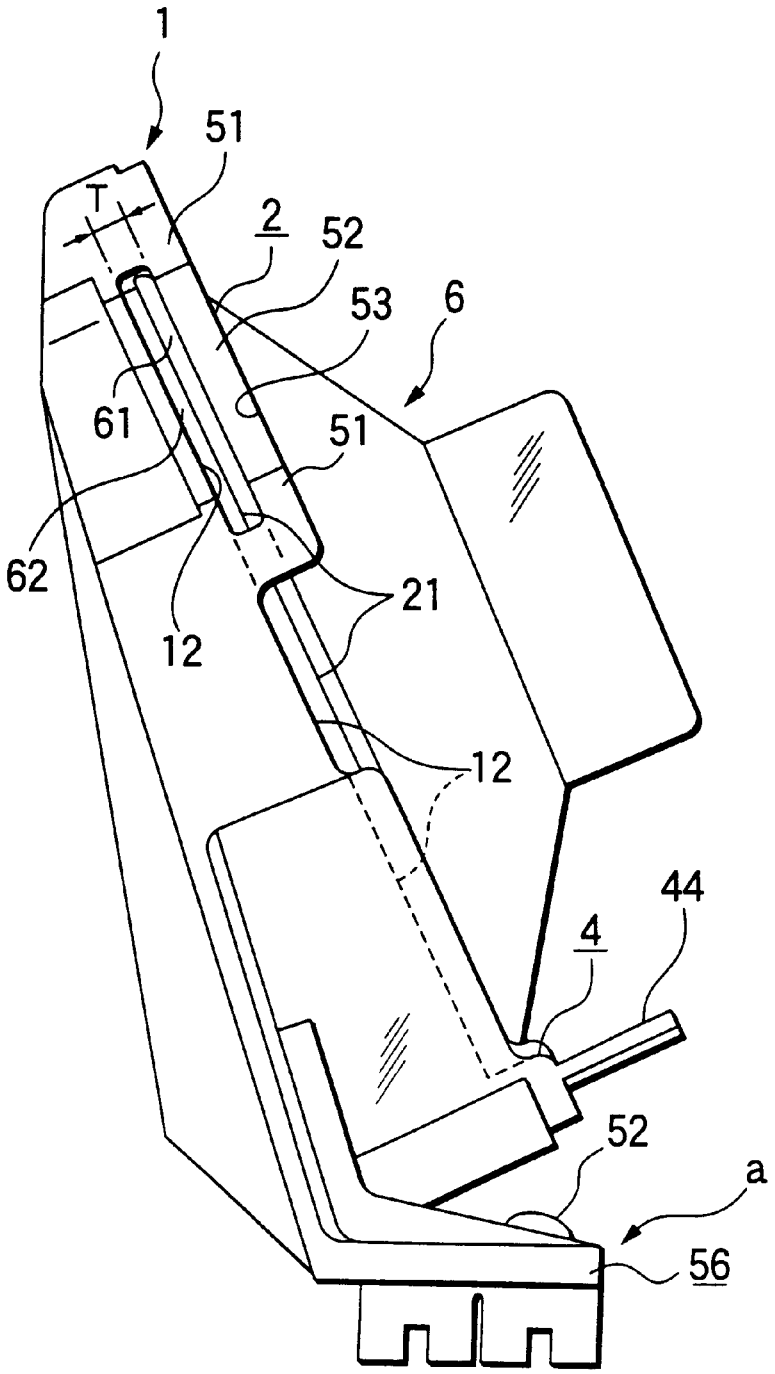
FIG. 8 is a side view showing the speaker device.

Of those first engaging frame parts, the first engaging frame part 2, as shown in FIG. 8, is formed with a couple of wide supporting parts 51 raised from the seat surface 12, a beam part 52 transversely extended between the supporting parts 51, a rectangular, sideways elongated opening 53 defined by the seat surface 12,the supporting parts 51 and the beam part 52. In the first engaging frame part 2, the supporting parts 51 and the elastic beam part 52 are relatively thick. Therefore, those parts have each a rigid elasticity proper to the synthetic resin. In the first engaging frame parts 2 and 3, as shown in FIG. 8, a distance between the seat surface 12 and the beam part 52 is substantially equal to the sum T of a thickness of the flange 61 of the speaker 6 at another location and the edge frame member 62. The same thing is true for the first engaging frame part 3.

As seen by analogy from FIG. 8, an annular edge frame member 62 formed of a wedge board is entirely formed on the front surface of the annular flange 61, which is provided on the outer periphery part of the speaker 6. In a state that the speaker 6 is attached to the holder 1, as shown in FIGS. 1 or 8, the first engaging frame parts 2 and 3, and the seat surface 12 cooperate to clamp the flange 61 therebetween at two locations. One second engaging frame part 4 and the seat surface 12 cooperate to clamp the flange 61 therebetween at one location.

Next, procedures to mount the speaker 6 to the holder 1 will be described, by way of example, with reference to FIGS. 5 to 7.

The flange 61 of the speaker 6 is fit, at two locations, to the first engaging frame parts 2 and 3. In this engagement state, another location of the flange 61 is pushed down to the vicinity of the seat surface 12 as in an arrow D in FIG. 5. The outer peripheral edge 61*a* of the flange 61 is moved while rubbing with the operating piece 44, and reaches the elastic beam part 42, and bends outward the elastic beam part 42 and the operating piece 44. Accordingly, the elastic beam part 42 and the operating piece 44 are pressed outward as shown. If another location of the flange 61 is further pressed down, the edge frame member 62 comes in contact with the seat surface 12 as shown in FIG. 6. At this time, the elastic beam part 42 is in resilient contact with the upper part of the outer peripheral edge 61 a of the flange 61. Then, if the operating piece 44 is inclined slightly outward with the operator's finger as indicated by an arrow U in FIG. 6, the elastic beam part 42 is twist deformed following the deformation of the operating piece 44. A distance H (see FIG. 4) between the seat surface 12 and the elastic beam part 42 is enlarged, and with the distance enlargement, the lower end of the elastic beam part 42 displaces in an arrow N. As a result, as shown in FIG. 7, the elastic beam part 42 runs on the rear surface of the flange 61 into engagement with the latter.

When the speaker 6 is thus attached to the holder 1, the two first engaging frame parts 2 and 3, one second engaging frame part 4, and the seat surface 12 cooperate to resiliently clamp the flange 61 of the speaker 6 and the edge frame member 62. Accordingly, the speaker 6 is attached to the holder 1 without screws. Further, the twist deformed elastic beam part 42 of the holder 1 always brings the flange 61 of the speaker 6 into resilient contact with the seat surface 12 by its action of elastically returning. Accordingly, the speaker 6 is attached to the holder 1 firmly or with no play. Additionally, a variation of the sum thickness T of the flange 61 and the edge frame member 62 is also absorbed through the elastic deformation of the elastic beam part 42 which was twist deformed and engaged with the rear surface of the flange 61. Therefore, even if the thickness dimension of the edge frame member 62 is varied from its design value, there is no chance that the speaker 6 mounted on the holder 1 plays. This fact contributes to suppress generation of a called chattering sound, and hence improves a quality of sound generated.

In the instant embodiment, the seat surface 12 and the operating piece 44 are curved inward to take a curved configuration as viewed from top. Accordingly, a large engaging width of the elastic beam part 42 when it is engaged with the rear surface of the flange 61 is secured, and the mounting state of the speaker 6 is stabilized correspondingly. Further, although the thickness of the elastic beam part 42 is thin, it exhibits a sufficiently large elasticity, so that the mounting of the speaker 6 is stabilized.

While in the embodiment, the holder 1 includes two first engaging frame parts 2 and 3, the first engaging frame part may be formed at one location or at more than two locations.

As seen from the foregoing description, the present invention enables one to mount the speaker on the holder without screws. Further, a stable mounting of the speaker is secured by absorbing a variation of the sum thickness of the flange of the speaker and the edge frame member. Therefore, generation of a called chattering sound caused by an instable mounting of a speaker is suppressed, thereby improving a quality of sound generated. The execution of work of mounting the speaker to the holder is facilitated.

What is claimed is:

1. A speaker device comprising:

a speaker provided with a flange extending along the outer periphery, said flange including an annular edge frame member formed of a wedge board on the front surface thereof, and a holder including an annular seat surface over which said edge frame member is entirely laid, and engaging frame parts provided at three locations on said seat surface, said engaging frame parts being engaged with the rear surface of said flange to position said flange and press said flange against said seat surface, wherein said engaging frame parts include each a pair of supporting parts raised from said seat surface, a beam part being transversely extended between said supporting parts and curved inward when viewed from top, and an opening defined by said seat surface, said supporting parts and said beam part, said engaging frame parts, when predetermined locations of said flange are inserted thereinto, are classified into two first engaging frame parts which clamp two of said predetermined locations in cooperation with said seat surface, and one second engaging frame part which clamps said remaining predetermined location in cooperation with said seat surface, said second engaging frame part is formed integrally with said holder made of synthetic resin by one-piece molding, and a beam part of said second engaging frame part is formed as an elastic beam part being bendable outward and twistable, a distance between said seat surface and said elastic beam part in said second engaging frame part is somewhat shorter than the sum of a thickness of said flange at said remaining location and a thickness of said edge frame member, when said elastic beam part is twisted, said distance between said seat surface and said elastic beam part is increased, and said elastic beam part comes in engagement with the rear surface of said flange at said remaining location, an operating piece for twisting said elastic beam part protrudes upward from a mid part of said elastic beam part, and said operating piece is curved inward to take a curved configuration as viewed from top, and when said remaining location of said flange which engages at said predetermined locations with said two first engaging frame parts is pushed down to the vicinity of said seat surface, said elastic beam part of said second engaging frame part is bent outward by the outer edge of said flange at said remaining part, and when said edge frame member comes in contact with said seat surface, said elastic beam part is brought into elastic contact with the outer edge of said flange.

2. A speaker device comprising:

a speaker provided with a flange extending along the outer periphery, said flange including an edge frame member on the front surface thereof, and a holder including an annular seat surface over which said edge frame member is entirely laid, and engaging frame parts provided at a plurality of locations on said seat surface, said engaging frame parts being engaged with the rear surface of said flange to position said flange and press said flange against said seat surface, wherein said plurality of engaging frame parts, when predetermined locations of said flange are inserted thereinto, are classified into first engaging frame parts which clamp said predetermined locations in cooperation with said seat surface, and a second engaging frame part which clamps said remaining predetermined location in cooperation with said seat surface, said second engaging frame part includes an elastic beam part, when said remaining location of said flange which engages at said predetermined locations with said first engaging frame parts is pushed down to the vicinity of said seat surface, said elastic beam part is bent outward by the outer edge of said flange at said remaining part, and when said edge frame member comes in contact with said seat surface, said elastic beam part is brought into elastic contact with the outer edge of said flange, and when said elastic beam part being in resilient contact with the outer edge of said flange is twisted, said elastic beam part comes in engagement with the rear surface of said flange at said remaining location.

3. The speaker device according to claim 2, wherein said second engaging frame part is formed integrally with said holder made of synthetic resin by one-piece molding, said second engaging frame part is formed with a couple of supporting parts raised from said seat surface, an elastic beam part transversely extended between said supporting parts, and an opening defined by said seat surface, said supporting parts and said elastic beam part, and a distance between said seat surface and said elastic beam part is somewhat shorter than the sum of a thickness of said flange at said remaining location and a thickness of said edge frame member, and when said elastic beam part is twisted, said distance between said seat surface and said elastic beam part is increased, and said elastic beam part comes in engagement with the rear surface of said flange at said remaining location.

4. The speaker device according to claim 3, wherein an operating piece for twisting said elastic beam part protrudes upward from a mid part of said elastic beam part.

5. The speaker device according to claim 4, wherein said elastic beam part and said operating piece are curved inward to take a curved configuration as viewed from top.

* * * * *